US008146605B1

(12) United States Patent
Laaly

(10) Patent No.: US 8,146,605 B1
(45) Date of Patent: Apr. 3, 2012

(54) HAIR STYLING IRON AND ATTACHMENT WITH INTERCHANGEABLE COMBS

(76) Inventor: Noushin Laaly, Los Angeles, CA (US)

( * ) Notice: Subject to any disclaimer, the term of this patent is extended or adjusted under 35 U.S.C. 154(b) by 363 days.

(21) Appl. No.: 12/555,818

(22) Filed: Sep. 9, 2009

(51) Int. Cl.
*A45D 24/10* (2006.01)
*A45D 1/00* (2006.01)
*A45D 20/08* (2006.01)

(52) U.S. Cl. ..... 132/118; 132/224; 132/271

(58) Field of Classification Search ..... 132/118, 132/224, 225, 271, 218, 120, 143, 144, 148, 132/155; 34/90; D28/18, 21–25
See application file for complete search history.

(56) References Cited

U.S. PATENT DOCUMENTS

| | | | | |
|---|---|---|---|---|
| 1,376,416 | A | 5/1921 | Forshee | |
| 1,407,214 | A * | 2/1922 | Osborn | 15/176.6 |
| 1,597,855 | A * | 8/1926 | Zahorsky | 15/400 |
| 1,625,537 | A * | 4/1927 | Gullickson | 15/176.1 |
| 3,903,905 | A * | 9/1975 | Tucker | 132/118 |
| 4,032,747 | A * | 6/1977 | Kunz | 219/222 |
| 4,040,432 | A * | 8/1977 | Adinolfi | 132/271 |
| 4,173,231 | A * | 11/1979 | Isino et al. | 132/271 |
| D273,520 | S * | 4/1984 | Frey | D28/18 |
| 4,936,027 | A * | 6/1990 | Tsuji | 34/90 |
| 6,158,443 | A | 12/2000 | Leman | |
| 6,191,387 | B1 | 2/2001 | Smal | |
| 2005/0236009 | A1 | 10/2005 | Park | |
| 2008/0302378 | A1 | 12/2008 | Rizzieri | |
| 2009/0014024 | A1 * | 1/2009 | Wong et al. | 132/225 |

* cited by examiner

*Primary Examiner* — Robyn Doan

(57) ABSTRACT

The quickness, relative effortlessness, and convenience associate with the an improved attachment for a hair styling iron or an improved hair styling iron, either one featuring interchangeable comb bristles assemblies located adjacent to and extended outwardly and perpendicular to a hair styling iron heating element for the purpose of contacting and positioning the hair strands in parallel arrangement before, during, and/or after application of heat from a hair styling iron heating element.

The interchangeable comb bristle arrangements may be composed of different bristle densities, thicknesses, and/or material to accommodate different types and thicknesses of hair. The improved attachment may be slid over a hair styling iron arm element and be secured to the hair styling iron using a retaining lip which hooks to engage an inner surface of the heating element arm and a security clip that attaches onto one end of the interchangeable comb bristle assembly.

3 Claims, 6 Drawing Sheets

HAIR STYLING IRON AND ATTACHMENT WITH INTERCHANGEABLE COMBS

CROSS-REFERENCE TO RELATED APPLICATIONS

None.

FEDERALLY SPONSORED RESEARCH

None.

JOINT RESEARCH AGREEMENT

None.

SEQUENCE LISTING OR PROGRAM

None.

BACKGROUND OF THE INVENTION

1. Field of Invention

This invention generally relates to hair styling devices, specifically to an improved attachment for a hair styling iron and a new hair styling iron featuring the ability to interchange different combs depending upon particular hair type and thickness, which ultimately enhances the effectiveness of the hair styling iron.

2. Discussion of Prior Art

The process of styling an individual's hair very often demands the straightening of that person's hair through the utilization of a hair styling iron. The use of the hair styling iron requires the selection of many strands of an individual's hair, inserting one end of that selected portion in between and perpendicular to the two heating elements of the hair styling iron, joining together the two heating elements while the selected portion of hair is positioned in between them, and subsequently sliding the hair styling iron towards the opposite end of that individual's hair.

The heat resonating from the two heating elements that surround the hair strands reshape and harden the hair in the same manner in which the hair exists at the time that the heat is applied. Therefore, if the hair strands are not arranged in straight or parallel fashion at the time of that heat from the two heating elements is applied to the hair strands, then those hair strands will not take the desired shape of straightened or styled hair.

For each application of the hair styling iron where the selected hair strands are not arranged in parallel at the time of heat application, such application is partially ineffective in straightening hair, and the same laborious process must be repeated to the inconvenience of the user. The repeated application of the hair styling iron before the selected hair strands is straightened to an acceptable degree is time and labor intensive. Therefore, there exists a high demand for an apparatus that improves the effectiveness and efficiency of the hair styling iron by arranging hair strands in parallel at the time that heat is applied by the hair styling iron.

Any prior inventions that have may have attempted to improve the effectiveness of the hair styling iron through the use a simple, generic comb-like attachment to a hair styling iron failed to improve the effectiveness of the underlying hair styling iron for different types and thicknesses of hair. Different types and thicknesses of human hair require different types of comb bristles in order to effectively arrange such hair strands in parallel to one another before and/or after the application of heat from the heating elements of the hair styling iron.

For instance, hair strands of relatively thinner cross-sectional diameter may not be adequately aligned in parallel by using comb bristles of lower density and with higher cross-sectional diameters. Such hair may be significantly better aligned in parallel through the use of comb bristles of higher density and with lower cross-sectional diameters.

The use of higher density comb bristles on thinner hair strands may better align those strands at the time that heat is applied by the hair styling iron and thereby significantly improve the effectiveness and efficiency of the underlying hair styling iron in straightening and styling hair. Therefore, the need for a hair styling iron attachment that effectively arranges human hair in parallel before application of the heating elements has not been satisfied by the prior art.

Additionally, there is a need that the comb bristles be interchangeable with relative ease and quickness. Professional hair stylists regularly use hair styling irons to style the hair of their customers, where each customer is likely to have a different hair type and thickness than a previous customer. If different comb bristles are permanently affixed to the hair styling iron, then more energy, time, and expense is required for such a professional hair stylist to acquire the multitude of different hair styling irons that will suit the wide range of hair types and thicknesses of that individual's customers.

This invention alleviates the need for excessive energy and expense by allowing the comb bristles to be interchangeable and customizable based on the different type of hair without requiring the hefty expense of purchasing multiple hair straightening irons. Therefore, there exists a demand for an improved hair styling iron and/or improved attachment for existing hair styling irons where the comb bristles most suitable for an individual's hair are interchangeable with relative ease and quickness without the need for multiple hair styling irons.

OBJECTS AND ADVANTAGES

Accordingly, one object and advantage of this invention is that the attachment body element is designed to accommodate a plurality of interchangeable comb teeth/bristles elements with varying comb bristles composed of different densities, thicknesses, and/or material in order to accommodate different hair types and thicknesses. Though prior art may disclose elements that resemble comb-like assemblies, such assemblies are non-interchangeable and fail to accommodate different hair types.

The improvement over any prior art is that this invention effectively improves the straightening capacity of the underlying hair styling iron for individuals with either thinner hair, which may require high-density comb teeth/bristles, as well as thicker hair, which may require lower-density comb teeth/bristles, or both, without the expense and energy of acquiring multiple hair styling irons or attachments therefor. The prior art fails to accommodate different hair thicknesses in its design, and therefore is ineffective for varying hair types and thicknesses.

Another object and advantage of this invention is that it is less expensive for a prospective manufacturer to make, and thus a prospective consumer to purchase, this invention, which consists of only one attachment body and multiple interchangeable comb elements, than multiple variations of the prior art, which would consists of multiple attachment bodies which each have only one non-interchangeable comb bristle assembly. Since the quantity of plastic required to make this invention for different hair types is anticipated to be less than the amount of plastic required to make multiple variations of the prior art in order to accommodate different hair types, the overall cost to the manufacturer, and consequently the overall cost to the consumer, is anticipated to be significantly lower. Therefore, this novel improvement to the hair styling iron is substantially more cost-effective and convenient as compared to the existing prior art.

An additional object and advantage of this invention is the existence of a securing clip that fastens to the attachment body and the comb assembly element in order to prevent the unintentional or accidental dislocation of that comb assembly element during its regular use and operation. Existing prior art does not contain any such securing clip element.

The improvement to the prior art is that the securing clip element causes the interchangeable comb element to remain securely connected to the attachment body element during ordinary use, during which time forces pulling against the interchangeable comb assembly element might otherwise cause that element to dislocate. Additionally, the securing clip element prevents dislocation during the times when the hair styling iron arm element is held vertically upright, where gravitational forces might otherwise cause the interchangeable comb assembly element to dislocate.

In summary, this invention is relatively inexpensive for manufacturers to produce and consumers to purchase; allows for relatively quicker straightening of hair; renders the straightened hair softer, shinier, and better separated; and requires less time to perform the hair straightening process on an individual. Its significant benefit of time-saving is in demand by busy consumers, who have little time and money to invest in expensive and lengthy hair styling activities with less efficient hair styling tools, and hair stylist professionals, who will be able to use this invention to service the hair styling demands of a substantially greater number of customers.

Further objects and advances of this invention will become apparent from a consideration of the drawings and ensuing description.

BRIEF SUMMARY OF THE INVENTION

An improved attachment for a hair styling iron or an improved hair styling iron, either one featuring interchangeable comb assemblies that extend into and configure hair strands in parallel arrangement at the time of application of heat from the hair styling. The interchangeable comb bristle arrangements may be composed of different bristle densities, thicknesses, and/or material to accommodate different types and thicknesses of hair. The improved attachment may be slid and substantially fit over the back surface of a compatible hair styling iron arm element and be secured to the hair styling iron using a retaining lip, which hooks to engage an inner surface of the heating element arm, as well as a security clip, which attaches over and secures the interchangeable comb bristle assembly.

In one embodiment, two interchangeable comb teeth/bristles assemblies are positioned on the two lateral sides of the heating element and parallel to the longitudinal axis of the heating element arm and of either the hair styling iron attachment or the improved hair styling iron.

In another embodiment, one interchangeable comb teeth/bristles assembly is positioned on one lateral side of the heating element and parallel to the longitudinal axis of the heating element arm and of either the hair styling iron attachment or the improved hair styling iron.

BRIEF DESCRIPTION OF THE SEVERAL VIEWS OF THE DRAWINGS

For a complete understanding of the present invention, and the advantages thereof, reference is hereby made to the following descriptions taken in conjunction with the accompanying drawings, in which like numbers designate like parts, and in which.

DRAWINGS

List of Reference Numerals

Figure 1:
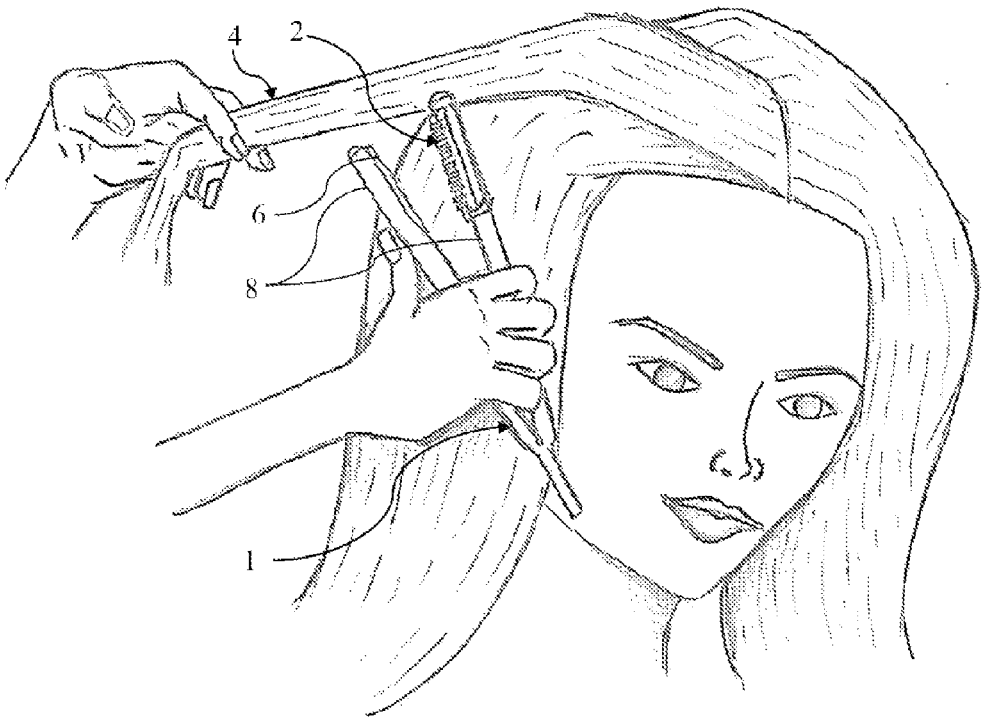
FIG. 1 is a perspective view of the present invention being utilized on a person in its conventional way for the purpose of straightening or styling human hair.

The reference numerals below are labels for the different elements as used in the drawings and are not intended to serve as a full description of each element or limit its scope of equivalent elements.

1 hair styling iron, generally
2 attachment body element, generally
2*a* attachment body element of preferred embodiment
2*b* attachment body element of alternative embodiment
4 hair strands
6 heating element of hair styling iron
8 arm element of hair styling iron
12 comb assembly element, generally
12*a* comb assembly element with wide-body comb teeth/bristles
12*b* comb assembly element with medium-body comb teeth/bristles
12*c* comb assembly element with narrow-body comb teeth/bristles
14 comb teeth/bristles element, generally
14*a* wide-body comb teeth/bristles element
14*b* medium-body comb teeth/bristles element
14*c* narrow-body comb teeth/bristles element
16 securing clip element, generally
16*a* securing clip element of preferred embodiment
16*b* securing clip element of alternative embodiment
20 ridge element on comb assembly element
22 grooved channel element of attachment body element
24 notch element in attachment body element
26 guiding channel element of attachment body element

30 retaining lip(s) element of attachment body element
28 cavity element in attachment body element
32 holes in comb assembly element

DETAILED DESCRIPTION OF THE INVENTION

Preferred Embodiment

Figure 2A:
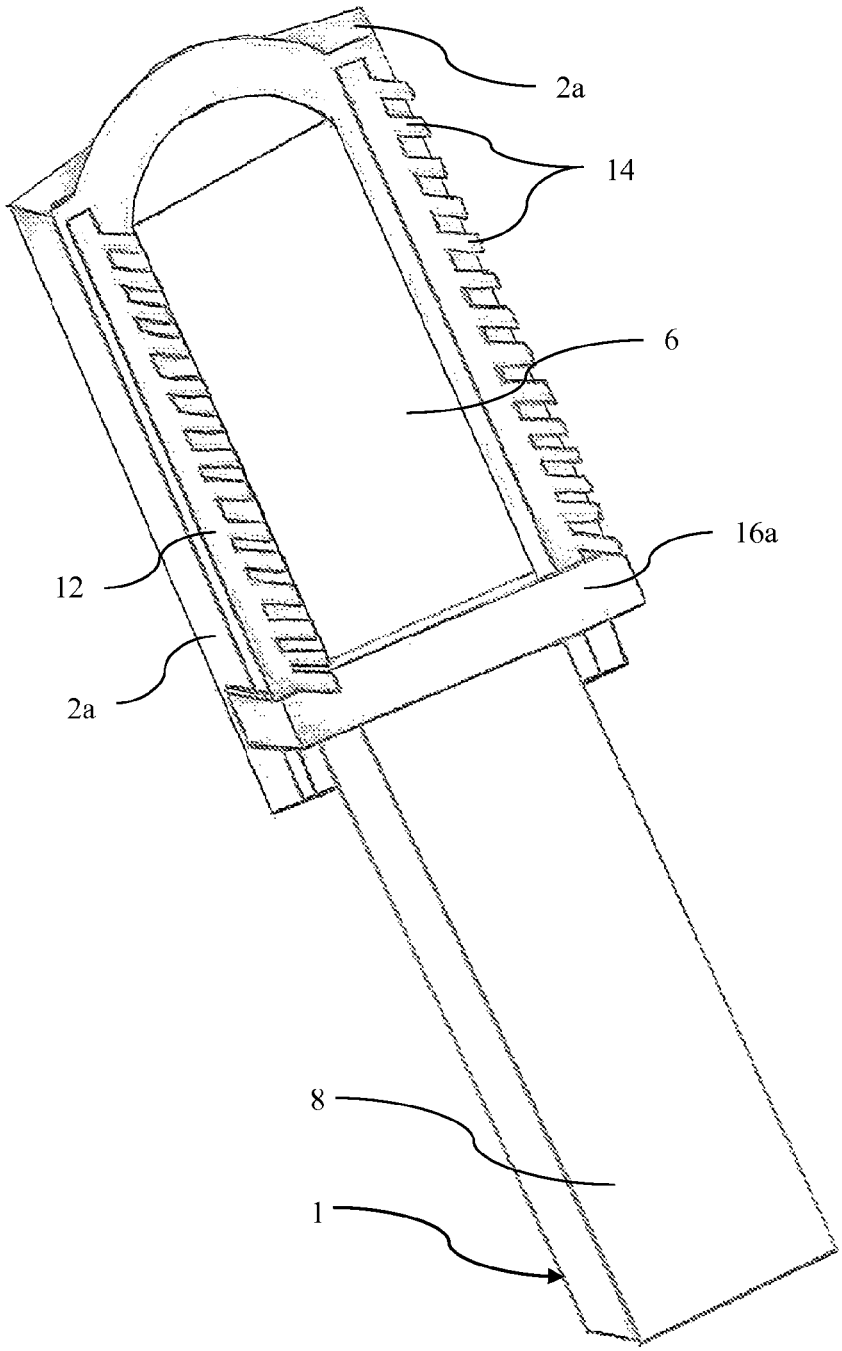
FIG. 2A is a perspective view of the preferred embodiment of the present invention, which includes two comb assemblies, as attached onto a single arm of a two-armed hair styling iron.
Figure 2B:
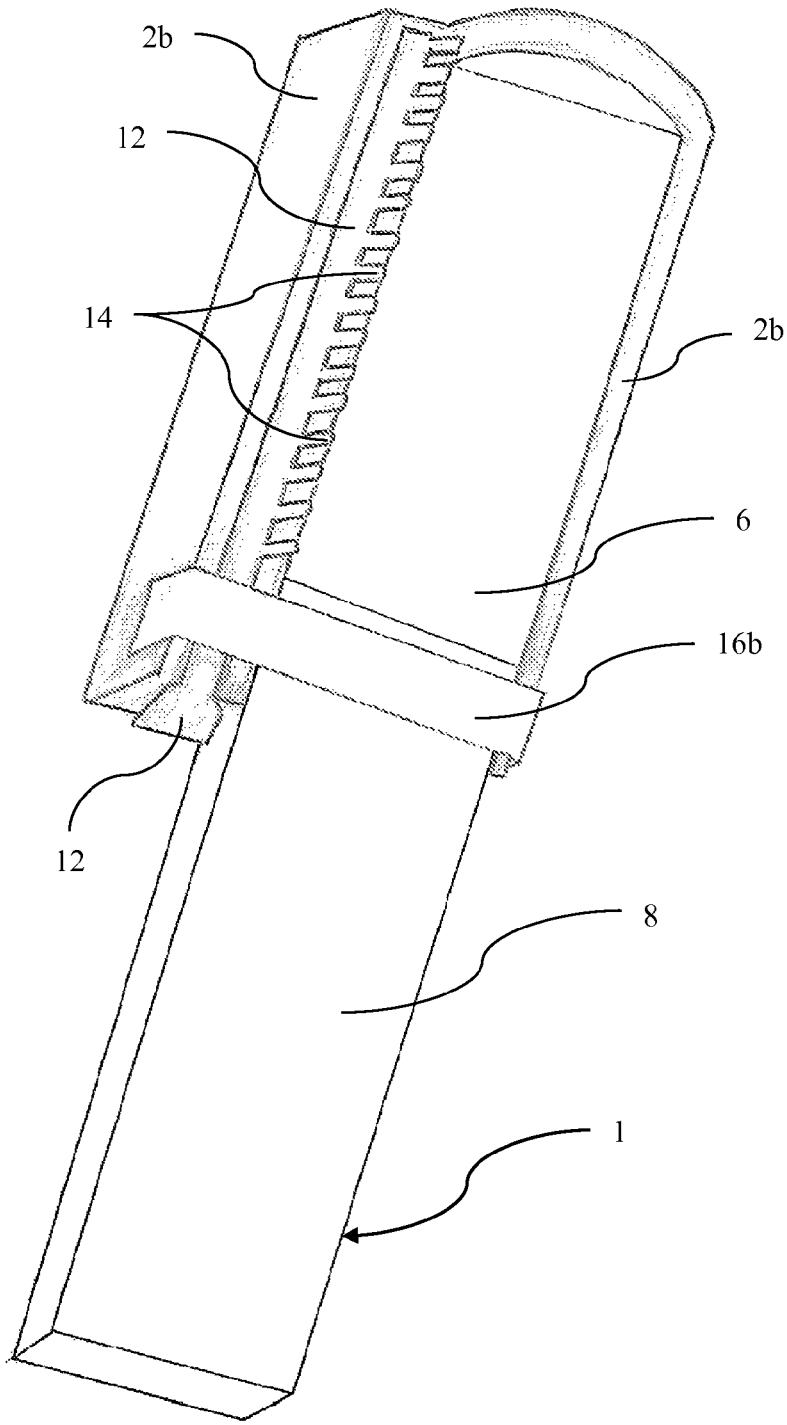
FIG. 2B is a perspective view of the alternative embodiment of the present invention, which includes one comb assembly, as attached onto a single arm of a two-armed hair styling iron.
Figure 3:
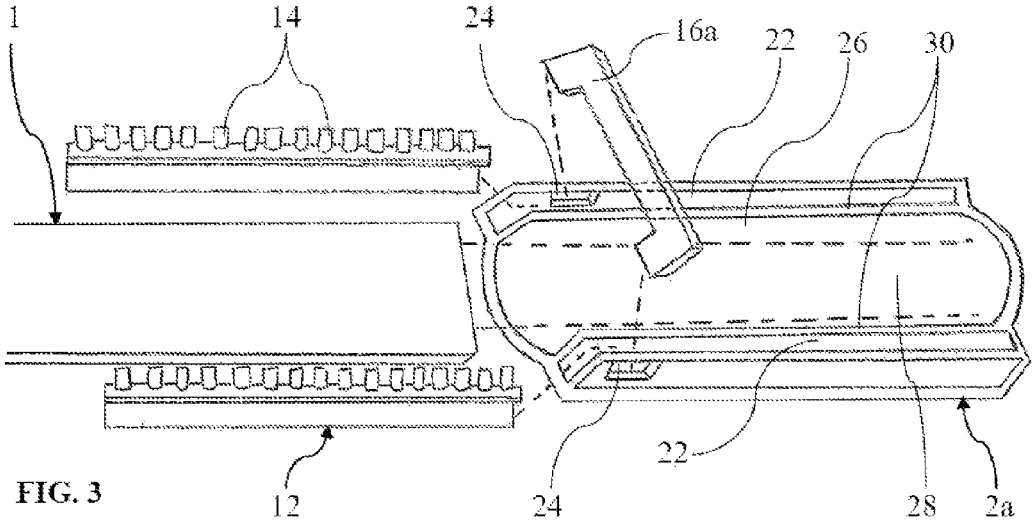
FIG. 3 is an exploded view of the preferred embodiment of the present invention, which includes two comb assemblies, showing the interconnections between the hair styling iron, the attachment body, the comb assemblies, the securing clip, and its other various components.
Figure 4A:
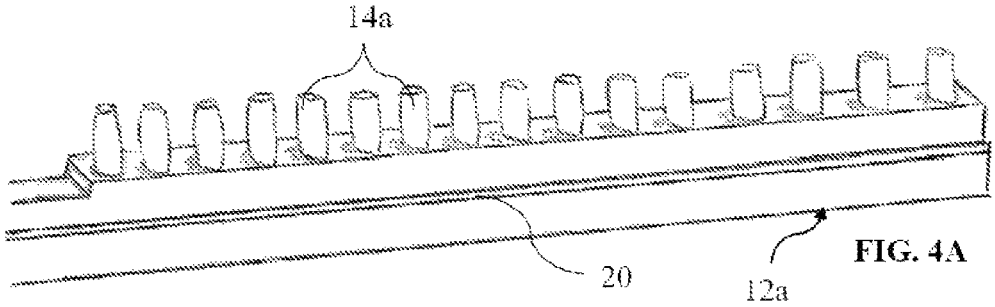
FIGS. 4A, 4B, and 4C and 4E are perspective views of the different comb assemblies that each include different comb teeth/bristles for different types of hair types and thicknesses.
Figure 4B:
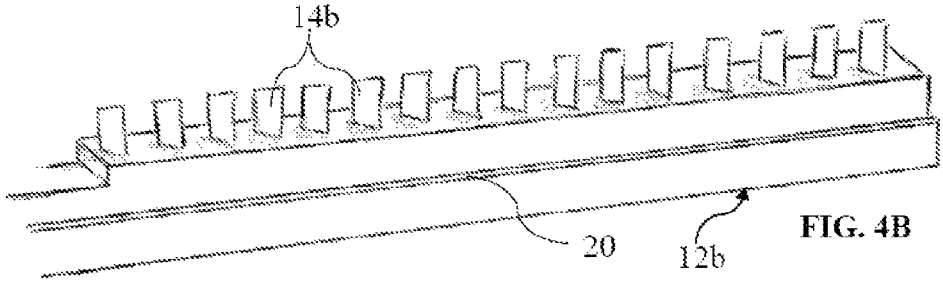
Figure 4C:
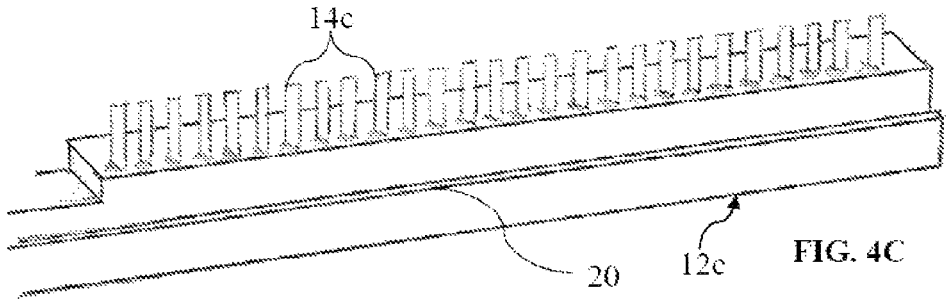
Figure 4D:
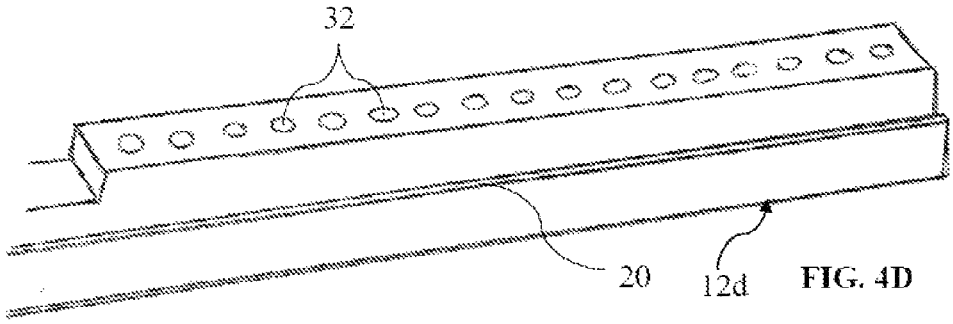
FIG. 4D is a perspective view of a comb assembly without any pre-installed comb teeth/bristles but containing holes wherein comb teeth/bristles can later be added.
Figure 4E:
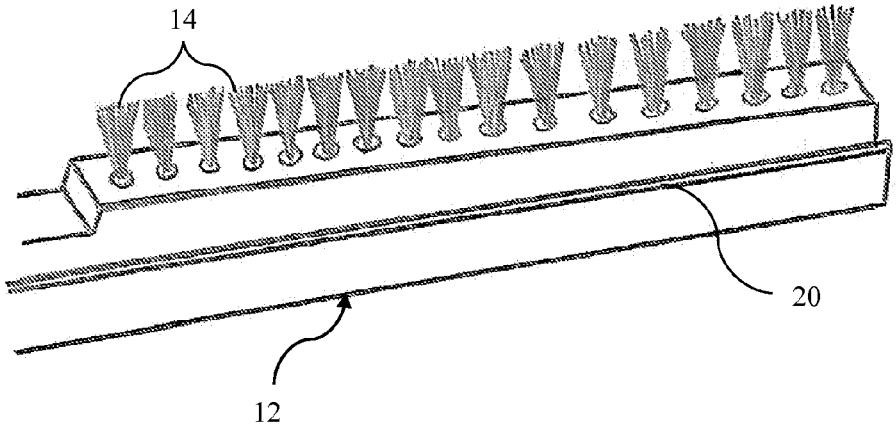

The preferred embodiment of the attachment body element 2*a* is illustrated in FIG. 2A and FIG. 3, and the alternative embodiment of the attachment body element 2*b* is illustrated in FIG. 2B. Each element of the present invention and their respective interrelatedness and interconnections are discussed in detail below.

At one end of the attachment body element is a large opening to a cavity element 28 wherein the arm element 8 of the hair styling iron 1 is inserted. For connecting the arm element 8 onto the attachment body element 2*a* or 2*b*, the attachment body element 2*a* or 2*b* may contain a cavity element 28 which is fitted for a particular arm element 8 of a particular hair styling iron 1.

Of the proximal and distal ends of the attachment body element 2*a* or 2*b*, at least one of these ends may be unblocked so as to allow the insertion of the arm element 8 into the cavity element 28. The arm element 8 can be placed into the cavity element 28 by inserting the top end of the arm element 8 into the unblocked end of the attachment body element 2*a*.

The attachment body element 2*a* or 2*b* is secured onto the arm element 8 by retaining lips 30, which are located substantially parallel to the longitudinal axis adjacent to the cavity element 28. The retaining lips element 30 functions to hold the attachment body element 2*a* or 2*b* onto the arm element 8. The retaining lips element 30 avoids contact with the heating surface element 6 of the arm element 8 and only contacts the non-heated portions of the arm element 8 that surround the heating surface element 6.

Positioned adjacent to the retaining lips element 30 and located along the lateral-most periphery of the attachment body 2*a* or 2*b* is a grooved channel element 22 for placement of a comb assembly element 12. The void between the retaining lips element 30 and the bottom of the cavity element 28 forms a narrow guiding channel element 26 to guide the insertion and removal of the arm element 8 into the cavity element 28 of the attachment body element 2*a*.

For connecting a comb assembly element 12 onto the attachment body element 2*a*, the attachment body element 2*a* may contain a grooved channel element 22 along the lateral edges of its longitudinal sides that is shaped in a particular way to accommodate a plurality of interchangeable comb assembly elements 12.

Each interchangeable comb assembly element 12 may contain a ridge element 20 that is shaped in a way to uniquely fit into a complimenting grooved channel element 22 located on the attachment body element 2*a*. Once one end of the comb assembly 12 is aligned with the grooved channel element 22, the comb assembly element 12 can be installed by applying light force onto the comb assembly element 12 in the direction parallel with the longitudinal axis of the styling iron arm 1 or attachment body element 2*a*.

As mentioned previously, each comb assembly element 12 may feature a ridge element 20 that uniquely fits the grooved channel element 22. The ridge element 20 on each comb assembly 12 is identical to the ridge element 20 located on other interchangeable comb assemblies 12*a*, 12*b*, 12*c*, and 12*d*.

A comb assembly element 12 may include a comb teeth/bristles element 14. Different interchangeable comb assemblies 12*a*, 12*b*, and/or 12*c* each contains different types of comb teeth/bristles elements 14*a*, 14*b*, and/or 14*c*, respectively.

Alternatively, the comb assembly element 12 may contain no pre-installed comb teeth/bristles element 14 but instead include small, cylindrical-shaped holes 32 wherein customized types of comb teeth/bristles elements 12 may be later installed.

The preferred embodiments of comb assembly elements 12 are shown in FIG. 4A, FIG. 4B, FIG. 4C, and FIG. 4D and FIG. 4E.

The comb teeth/bristles element 14 consists of a plurality of comb teeth/bristles, which protrude perpendicularly away from the plane of the styling iron heating surface 6 to an extent that is sufficient to adequately engage the hair strands 4 during regular application of the styling iron 1 onto the hair strands 4. The comb teeth/bristles element 14 performs the highly important task of straightening hair before that hair is applied to the heating element 6 of the hair styling iron 1.

Since the heating elements 6 of the styling iron 1 cause the hair to preserve the shape of the hair as it existed at the time that heat was applied to it, it is very important that the hair strands 4 be as straight and parallel to each other as possible at the time that it is exposed to the heating element 6. The comb teeth/bristles element 14 engages and arranges the hair strands 4 parallel to each other and thereby causes the hair strands 4 to become straight before and/or after application of the heating element 6.

Different comb assembly elements 12*a*, 12*b*, and 12*c* can include different compositions of comb teeth/bristles elements 14*a*, 14*b*, and 14*c*, respectively.

Alternatively, a comb assembly 12*d* may not have pre-installed comb teeth/bristles 14 and instead feature a plurality of small, cylindrical-shaped holes 32 in which new or customized comb teeth/bristles 14 may be later installed to accommodate an even wider range of hair types and/or thicknesses.

One comb teeth/bristles element 14 can be more or less suited for different types and thicknesses of hair strands 4 of the person on whom the styling iron is being utilized. In other words, one configuration of comb teeth/bristles element 14 may be more effective in straightening one type or thickness of hair than another type. The user of the present invention can easily interchange and select the comb teeth/bristles element 14 that best suit their hair type and thickness, thereby improving the effectiveness of the underlying hair styling iron.

After the comb assembly element 12 is inserted into the attachment body element 2*a* or 2*b*, a securing clip element 16 is positioned perpendicular to, coplanar with, and superimposed on top of a portion of the comb assembly element 12. The securing clip element 16*a* and 16*b* can be attached to the attachment body element 2*a* and 2*b*, respectively, by engaging the ends of the securing clip element 16 onto the notch element 24 located on the attachment body element 2.

The securing clip element 16 prevents the unintentional dislocation of the comb assembly element 12 from the attachment body element 2*a* or 2*b* during use of the hair styling iron 1. After a comb assembly element 12 is installed onto the attachment body element 2*a* or 2*b*, a securing clip element 16 may be connected to the attachment body element 2*a* or 2*b* for the purpose of block or preventing the unintentional dislocation of the comb assembly element 12.

The foregoing description of a preferred and alternative embodiment of the invention has been presented for the purpose of illustration and description. It is not intended to be exhaustive or to limit the invention to the precise form disclosed. The embodiments were chosen and described to prove an illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

DETAILED DESCRIPTION OF THE INVENTION

Operation of Invention

To employ the present invention, the user can select and gently lift a group of hair strands 4 that the user wishes to straighten or style using the hair styling iron 1. The user can separate the two arm elements 8 of the hair styling iron 1. Thereafter, the user can place the hair strands 4 in between the heating elements 6 of the arm elements 8 in a manner such that the hair strands 4 are proximal to the scalp and simultaneously perpendicular to the longitudinal axis of the hair styling iron 1. The user can then close the two arm elements 8 such that the hair is positioned in between the two heating elements 6. While continuing to hold the hair strand 4, the user can move the hair styling iron in a direction distal to the scalp until reaching the substantial end of the hair strand 4.

During this movement, the comb teeth/bristles element 14 of the comb assembly element 12 will engage, arrange in parallel, and/or straighten the hair strand 4 before and/or after the hair strand 4 is exposed to the heat of the heating elements 6. Consequently, the comb teeth/bristles element 14 will cause the hair strand 4 to enter and/or leave the heating element 6 straighter.

Because the heat from the heating element 6 causes the hair strands 4 to preserve its shape as it existed at the time that heat was applied to it, the ultimate result will be that the hair strand 4 will emerge from the hair styling iron 1 significantly straighter and substantially better styled than if the present invention was not utilized.

The type and arrangement of comb teeth/bristles in a particular comb teeth/bristles element 14 may be more effective in straightening the hair strand 4 than another type and arrangement of comb teeth/bristles in another comb teeth/bristles element 14 because different types and thicknesses of hair may behave differently upon application of different types and arrangements of comb teeth/bristles.

Perhaps thinner hair may become better straightened upon the application of high-density, narrow-body comb teeth/bristles 14*c*. Alternatively, thicker hair may become better straightened upon the application of low-density, wide-body comb teeth/bristles 14*a*. The present invention offers the significant feature of easy, convenient, and quick interchangeability of different comb assembly elements 12 that have different comb teeth/bristles elements 14.

To remove a comb assembly element 12, the user need only dislodge and remove the securing clip element 16 from the notch element 24 and slide outward the comb assembly element 12 from its housing in the grooved channel element 22 of the attachment body element 2.

To add a different comb assembly 12, the user need only slide inward the selected alternative comb assembly element 12 and subsequently replace the securing clip element 16 and secure its ends into the notch element 24.

The quickness, relative effortlessness, and convenience associate with the interchangeability of different comb assembly elements 12 is of significant value to busy consumers and hair stylist professionals who do not have excess time, energy, and money to waste in the performance of hair styling and straightening activities.

What is claimed is:

1. A hair styling iron for use in styling hair comprising:

A pair of arm elements pivotally coupled with a hinge at the proximal end of the arm elements, a heating element located at the interior distal end of both of the arm elements; an end body element comprising a shell with a cavity element shaped to be compatible with a back side of one and/or both of the arm elements, whereby the upper portion of one or two of the arm elements is moveably inserted into the cavity element, the end body element also having a notch located on a side of the proximal or distal end of the end body element; a comb assembly element comprising a plurality of comb teeth/bristles that extend perpendicularly away from a surface of the heating element, the comb assembly further comprising attachment means for removably attaching the comb assembly element onto the end body element, wherein the end body element having two grooved channels positioned on both lateral sides of, and substantially parallel to a longitudinal axis of, the end body element, whereby the grooved channels allows for slidable insertion and removal of the comb assembly element into the end body element; and a securing clip element including an end piece element located at a longitudinal tip of the securing clip for attaching the securing clip onto the end body element, wherein the end piece element engages and attaches onto the notch of said end body element in order to block the unintentional dislocation of the comb assembly element from the end body element.

2. The apparatus according to claim 1, wherein the attachment means of the comb assembly element comprises a ridge at its side where such ridge is compatible with and fits inside the grooved channel of the attachment means of the end body element, whereby the ridge slides along the grooved channel for the purpose of securely inserting the comb assembly element into the end body element.

3. The apparatus according to claim 1, wherein the comb assembly element comprises a plurality of holes located at a top surface of the comb assembly element, whereby alternative comb teeth/bristles that engage, arrange, or straighten a particular type and thickness of hair may be later installed.

* * * * *